US007549611B2

(12) United States Patent
Hertel

(10) Patent No.: US 7,549,611 B2
(45) Date of Patent: Jun. 23, 2009

(54) HINGED DERAIL WITH ASSISTED MANUAL LIFTING AND METHOD FOR CONSTRUCTING

(75) Inventor: Kevin Hertel, Richmond, IN (US)

(73) Assignee: Western-Cullen-Hayes, Inc., Chicago, IL (US)

( * ) Notice: Subject to any disclaimer, the term of this patent is extended or adjusted under 35 U.S.C. 154(b) by 99 days.

(21) Appl. No.: 11/567,291

(22) Filed: Dec. 6, 2006

(65) Prior Publication Data

US 2008/0023592 A1 Jan. 31, 2008

Related U.S. Application Data

(63) Continuation-in-part of application No. 11/493,115, filed on Jul. 26, 2006.

(51) Int. Cl.
*B61L 19/02* (2006.01)
*B61K 5/00* (2006.01)

(52) U.S. Cl. ..... 246/163; 104/262

(58) Field of Classification Search ..... 104/261, 104/262; 246/163; 29/428, 435, 436, 446
See application file for complete search history.

(56) References Cited

U.S. PATENT DOCUMENTS 988,190 A 3/1911 Hayes
1,431,066 A * 10/1922 Vannatter ..... 246/163
1,464,606 A * 8/1923 Hayes ..... 246/163
1,464,607 A * 8/1923 Hayes ..... 246/163
1,627,092 A * 5/1927 Hayes ..... 246/163
1,702,083 A * 2/1929 Hayes ..... 246/163
2,430,567 A * 11/1947 Hayes ..... 246/163
3,517,186 A * 6/1970 Hayes ..... 246/163
6,068,432 A * 5/2000 Schifsky ..... 410/3
6,105,906 A * 8/2000 Pease et al. ..... 246/163
6,178,893 B1 * 1/2001 Pease ..... 104/261
6,202,564 B1 * 3/2001 Hart et al. ..... 104/261
2008/0022882 A1 * 1/2008 Hertel ..... 104/262
2008/0023592 A1 * 1/2008 Hertel ..... 246/163
2008/0121778 A1 * 5/2008 Imajou ..... 248/590

* cited by examiner

*Primary Examiner*—S. Joseph Morano
*Assistant Examiner*—Jason C Smith
(74) *Attorney, Agent, or Firm*—Banner & Witcoff, Ltd.

(57) ABSTRACT

This invention relates to hinged derail assemblies used in the railroad industry for derailing a wheel of an undesirably moving railed vehicle. The hinged derail assembly includes a base that is positioned adjacent one rail of a pair of railroad rails. A derail shoe is pivotally mounted on the derail base and is moveable between a derailing position and an inoperative position. In the present invention a biasing member, such as a torsion spring, is secured to both the base of the hinged derail assembly and the derail shoe. The spring provides upward lifting force whether the derail shoe is in the inoperative position or in the derailing position. This lifting force assists the worker in the manual lifting of the derail shoe. The invention also relates to a method of constructing the hinged derail wherein the torsion spring is installed when the derail shoe is generally upright.

12 Claims, 4 Drawing Sheets

56
60
24
68
69
20
36
54
58
67
64
38
66
52
48
40
22
50

56
24
54
68
20
69
60
38
36
66
64
32
76
67
34

70
72
28
74
46
30
48
50
22
44

68
24
105°
65°

64
69
20
66
76
44
46
32
50
72
67
28
36
48
34
40
26
38
30

HINGED DERAIL WITH ASSISTED MANUAL LIFTING AND METHOD FOR CONSTRUCTING

REFERENCE TO RELATED APPLICATION

This application is a continuation-in-part application of U.S. application Ser. No. 11/493,115 filed on Jul. 26, 2006.

BACKGROUND OF THE INVENTION

This invention relates generally to safety equipment, namely, derails, which are commonly used for derailing railed vehicles, particularly powered and non-powered railroad cars such as box cars, flat bed railroad cars and the like, which are undesirably moving along railroad tracks. More specifically, the invention relates to hinged derails which may be selectively positioned adjacent one of a pair of railroad tracks for movement between an operating position for engaging and derailing a wheel of an undesirably moving railroad car and an inoperative position for allowing a moving railroad car to pass by the derail without undesirably engaging and derailing the moving railroad car. This invention also relates to a method for constructing the hinged derail of the invention.

Derails of various types have been used for many years in the railroad industry, some derails being in excess of one hundred years old. Derails are commonly used as safety devices to prevent or limit unintended or undesired movement of a railroad car, such as a box car. Derails have been used extensively, such as along side rails adjacent to a main line track for railroad trains and in railroad yards where railroad cars are constantly being moved, such as between coupled positions and uncoupled positions. Typical derails are configured to be manually or automatically moveable between a retracted or inoperative position in which a deflecting block is disposed adjacent but away from a rail for allowing free movement of a railroad car past the derail and alternatively, at a deployed or operative position in which the deflecting block is positioned on top of and aligned with one of a conventional pair of railroad rails for engaging and deflecting an oncoming wheel of an undesirably moving railroad car off the track or pair of rails. These derails cause the one wheel to be deflected and thereby the car to be deflected to a stopped, non-moving position so as to avoid injury to other equipment or to personnel.

Generally speaking, hinged derails include a deflecting block rigidly mounted on a derail shoe. The derail shoe is pivotal about a pivot axis, mounted on a base secured to a pair of railroad ties adjacent one of a pair of rails. Examples of such hinged derails may be seen, for example, in Hayes U.S. Pat. No. 988,190; Hayes U.S. Pat. No. 1,464,607; Hayes U.S. Pat. No. 1,627,092; Hayes U.S. Pat. No. 1,702,083; Hayes U.S. Pat. No. 2,430,567; Hayes U.S. Pat. No. 3,517,186; and Pease U.S. Pat. No. 6,178,893 B1.

In the operation of hinged derails, a derail shoe is pivoted between the retracted or inoperative position, which is spaced away from the railroad rail, and a deployed position or operative position where the deflecting block of the derail shoe is aligned generally on top of a rail. Proper alignment requires both lateral alignment and vertical alignment to a location on top of the rail with the deflecting block positioned to engage the leading wheel of an undesirably moving railroad car. The base of the derail is generally affixed to a pair of railroad ties of the type commonly used in the railroad industry, with attachment being accomplished generally by spikes driven through openings in the base into the ties. The base is mounted on the ties, in the area between a pair of rails and in a position operatively adjacent to one of the rails.

Once the derail is in position, that is, affixed to the railroad ties, the installed derail is in a substantially permanent position. The derails are made of solid steel and are very heavy as they must derail a heavy, moving rail car. The pivoted derail shoe itself may weigh in the range of 80-120 pounds. A double ended derail, to be described, is heavier and has a weight of up to about 120 pounds while a single ended derail is closer to the lower end of the range. Clearly, any of the heavy derail shoes are not easily manually rotated between operative and inoperative positions. In the inoperative position, the derail shoe, being pivotally mounted to the derail base, is deployed away from the adjacent rail in a substantially aligned position on the base in a position with the derail block facing downwardly and away from the rail so as to allow a moving railroad car to pass without being derailed. When desired, the railroad worker must manually lift the pivoted derail shoe in an upward circular motion and then rotate it downwardly into position with the deflecting block on top of the rail so the deflecting block will be in a position for engaging the wheel of a railroad car which is moving in an undesired manner. This means that the railroad worker must physically bend down and manually and rotatably lift the derail shoe about the pivot axis of the attachment to the base and move the derail shoe to the operative position on the rail. This action is physically difficult and can cause physical injury, such as to the back of the railroad worker. Similarly, when the derail shoe with the deflecting block is moved by the worker in the opposite direction, that is, from the deflecting or operative position to the inoperative position, the same problem occurs, that is the heavy derail shoe must be lifted and rotated in the opposite direction to the inoperative position. Again, the operator risks or may even encounter serious injury such as to the back.

Thus, there is a clear need for a hinged derail that significantly reduces the stress placed on an operator's back in rotationally moving the derail shoe both from the inoperative position to the operative position on the rail and from the operative position to the inoperative position. In addition, there is a need to provide forcible lifting assistance to the required manual lifting of the derail shoe without using expensive parts, and without adding weight to the already heavy derail shoe. Finally, there is a need to provide a method for constructing the hinged derail of this invention in an efficient and economical manner.

SUMMARY OF THE INVENTION

The above mentioned need for assistance in manually moving the derail shoe both from the inoperative position to the operative position and from the operative position to the inoperative position is accomplished by providing a biasing member on both the derail base and the derail shoe wherein the biasing member provides lifting assistance to the manual lifting of the shoe when the shoe is in both the operative position and the inoperative position. Preferably, a torsion spring is physically positioned around a pivot shaft which is mounted on the derail base and on the derail shoe and which provides a pivot axis for the derail shoe. One end of the torsion spring is secured to the base and the other end of the torsion spring is affixed to the derail shoe. More preferably, the design of the torsion spring is such that it provides lifting force for assistance to the worker to relieve stress on the worker when the derail shoe is lifted and rotated. This is accomplished by designing the torsion spring to be in a stressed condition, that is, in a wound condition or in an unwound condition, when the derail shoe is in the full operative position or in the full inoperative position. In one embodiment, where the derail shoe is relatively light in weight, the torsion spring is in a stressed, unwound condition when the derail shoe is in inoperative, on the rail and is in a stressed, wound condition when the derail shoe is the inoperative, off-rail position. Similarly, another embodiment, when the derail shoe is relatively heavy in weight, such as in the case of a double ended derail, the torsion spring is also in a stressed, unwound condition when the derail shoe is in the inoperative, off rail position and is in a stressed, wound condition when the derail shoe is in the operative, on rail position. The spring is designed to be in a substantially relaxed position when in a generally upright position. The operator thereby has the benefit of the lifting force of the torsion spring both when the spring is in the stressed, wound position and in the stressed, unwound position with the spring being substantially relaxed or unstressed in the upright position. The use of the torsion spring adds no weight to the pivoted derail shoe, requires no external assistance such as from a powerized source, and is of economical design. The method for manufacturing the hinged derail with the torsion spring involves installing the spring when the shoe is generally upright relative to the base and when the spring is relaxed to thereby enable the spring to provide the desired lifting force for assisting the worker when the derail is in both the operative position and in the inoperative position.

BRIEF DESCRIPTION OF THE DRAWINGS

The accompanying drawings are incorporated into and form part of the description of the invention. The drawings illustrate certain embodiments of the present invention and, together with the detailed description of the invention provided below, serve to explain and describe preferred embodiments of the invention. The drawings are not to be construed as limiting the scope of the invention but are intended to assist in fully describing the invention.

Referring to the Drawings

DETAILED DESCRIPTION OF THE INVENTION

The Embodiment of FIGS. 1-8

Figure 1:
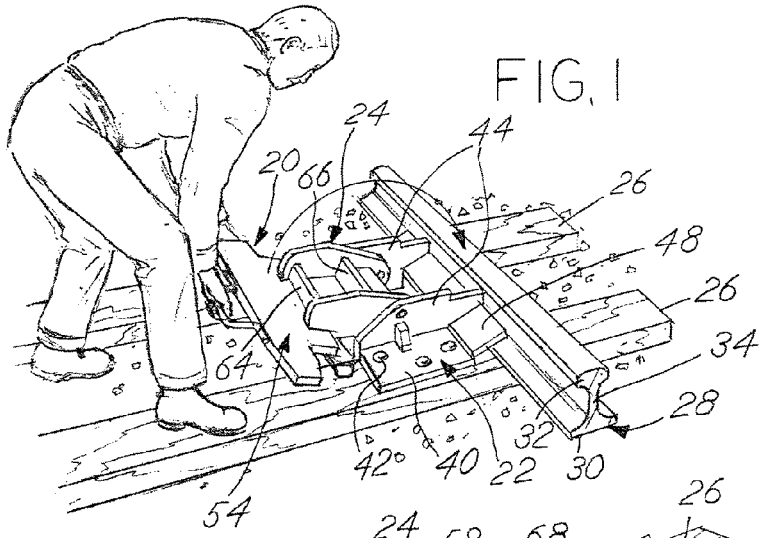
FIG. 1 is a perspective view of a railroad worker moving the derail shoe of one embodiment of a derail, made in accordance with the invention, from the inoperative position to the operative position.
Figure 2:
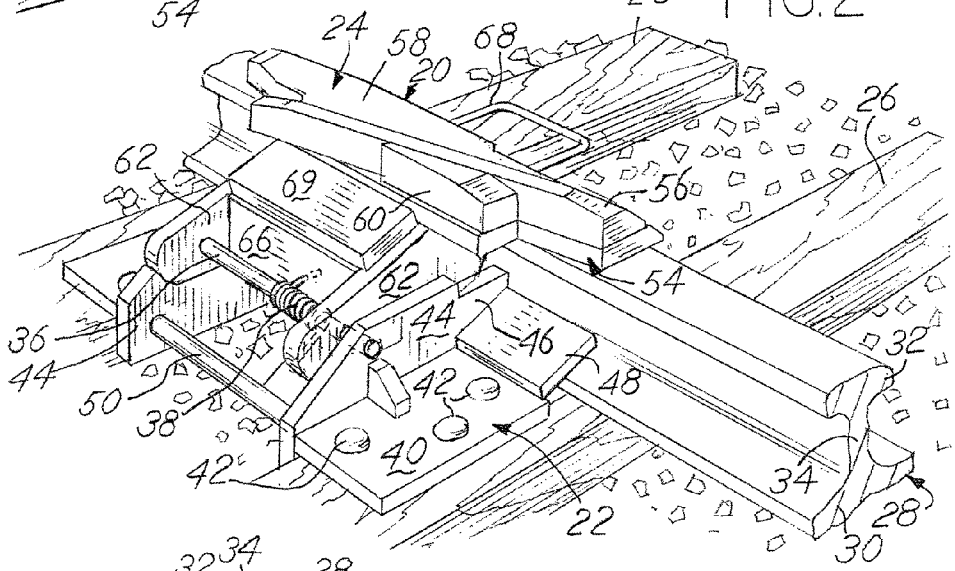
FIG. 2 is perspective view of the derail embodiment of FIG. 1 with the derail shoe of the invention being in the operative position with the deflecting block positioned for engaging the wheel of an undesirably moving railroad car.
Figure 3:
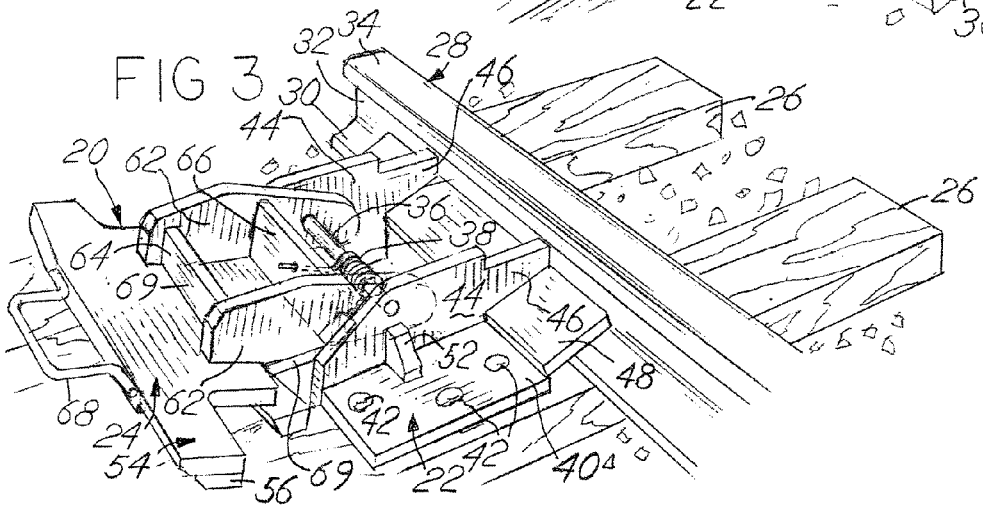
FIG. 3 is a perspective view, similar to FIG. 2, showing the derail shoe of one embodiment of the present invention being in the inoperative position with the deflecting block spaced away from the top of the rail.

Referring to FIG. 2, one derail assembly, generally 20, of the present invention is shown in the operative or derailing position, as will be described in more detail hereinafter. The derail assembly 20 includes a derail base, generally 22, which pivotally carries a derail shoe, generally 24. FIGS. 1-3 illustrate a pair of spaced railroad ties 26 of conventional construction, usually of wood or other material which can be penetrated by conventional railroad spikes. As shown in FIGS. 1-3, a section of a railroad rail, generally 28, in a conventional manner rests upon the outer portions of the railroad ties 26, transversely thereto. The rail 28 is of conventional steel construction and includes a lower rail flange 30 which rests upon the upper portion of the railroad ties 26, an upper rail flange 32 and a generally upright web 34 which unitarily interconnects the lower rail flange 30 with the upper rail flange 32.

Referring to FIG. 2, the derail assembly 20 is shown in the operative position. The derail assembly 20 is shown in the inoperative position in FIG. 3. In the operative position, the derail shoe 24 is operatively positioned on the upper surface of the upper flange 32 of the rail 28. Referring to FIG. 3, the derail shoe 24 of the derail 20 is pivotally mounted about a pivot shaft 36 which is spaced laterally inwardly from the rail 28 and is rigidly mounted on the derail base 22, as will be described hereinafter in greater detail.

A torsion spring member, generally 38, as seen in pictorial view in both FIGS. 2 and 3 provides upward biasing or lifting assistance to the operator when the operator manually lifts the derail shoe 24, when the derail shoe 24 is both in the inoperative position of FIG. 3, and in the operative position of FIG. 2. Specifically, the torsion spring 38 is designed to be in a stressed condition, that is, in the wound or unwound conditions when the derail 20 is in either the operative position (FIG. 2) or the inoperative position (FIG. 3).

Referring to FIGS. 2-6, the derail base 22 of the present invention is generally of welded steel construction. The derail base 22 includes a pair of spaced horizontal plates 40, each of which rests upon the upper surface of each of the spaced railroad ties 26. The horizontal plates 40 include multiple apertures 43, as seen in hidden view in FIG. 5, for allowing the passage of multiple railroad spikes 42 which are driven into the spaced railroad ties 26 in a conventional manner to secure the assembly 20 in place on the ties 26. The inner facing edges of the horizontal plates 40 each have upright, rigid support flanges 44 mounted thereon, as by welding. The outer faces of the flanges 44 project towards and bear against the inner facing edges of the railroad ties 26 and provide added positioning support for preventing rotational and transverse movement of the derail base 22 and the derail assembly 20 when securely positioned on the ties 26 and adjacent the rail 28. The upright flanges 44 each include a unitary projection 46, having upwardly angled lower portions, which project towards the rail 28. An angled cross support 48 is rigidly welded to the under portions of the projections 46 of the upright flanges 44. The angled cross support 48 extends generally for the entire width of the derail base 22 and is positioned against the upper face of the lower flange 30 of the rail 28. The angled support 48 is also welded to the inner facing edges of the horizontal plates 40 of the derail base 22.

A rigid support rod 50 is welded to the outermost portions of the upright flanges 44. The support rod 50 provides added rigid strengthening for the derail base 22. Preferably, the support rod 50 is in general alignment with the horizontal plates 40. In order to provide further support for the base 22, a pair of support blocks 52 are welded to the upper surface of each horizontal plate 40 and to the outer face of each of the upright flanges 44. Each block 52 is rigidly positioned just below the pivot shaft 36. In summary, the derail base 22 is of heavy duty, rigid, construction and design accomplished by the spaced horizontal plates 40, the upright flanges 44, the angled flange 48, and the support rod 50. The derail assembly 20 is securely positioned adjacent the rail 28 once the spikes 42 are driven through the apertures 41 provided in the horizontal plates 40.

Referring to the perspective views FIGS. 2 and 3, the pivotal derail shoe 24, like the base 22, is of welded steel construction. The derail shoe 24 includes a horizontal deflecting plate 54 which is designed to rest upon the upper surface of the upper flange 32 of the rail 28 when in the operative, derailing position, as seen in FIG. 2. Specifically, the lower surface of the deflecting plate 54, when in the operative position, bears against the upper rail flange 32. A deflecting bar 56 is mounted by welding onto the upper surface 58 of the deflecting plate 54, as seen when the derail shoe is in the operative position of FIG. 2.

Figure 4:
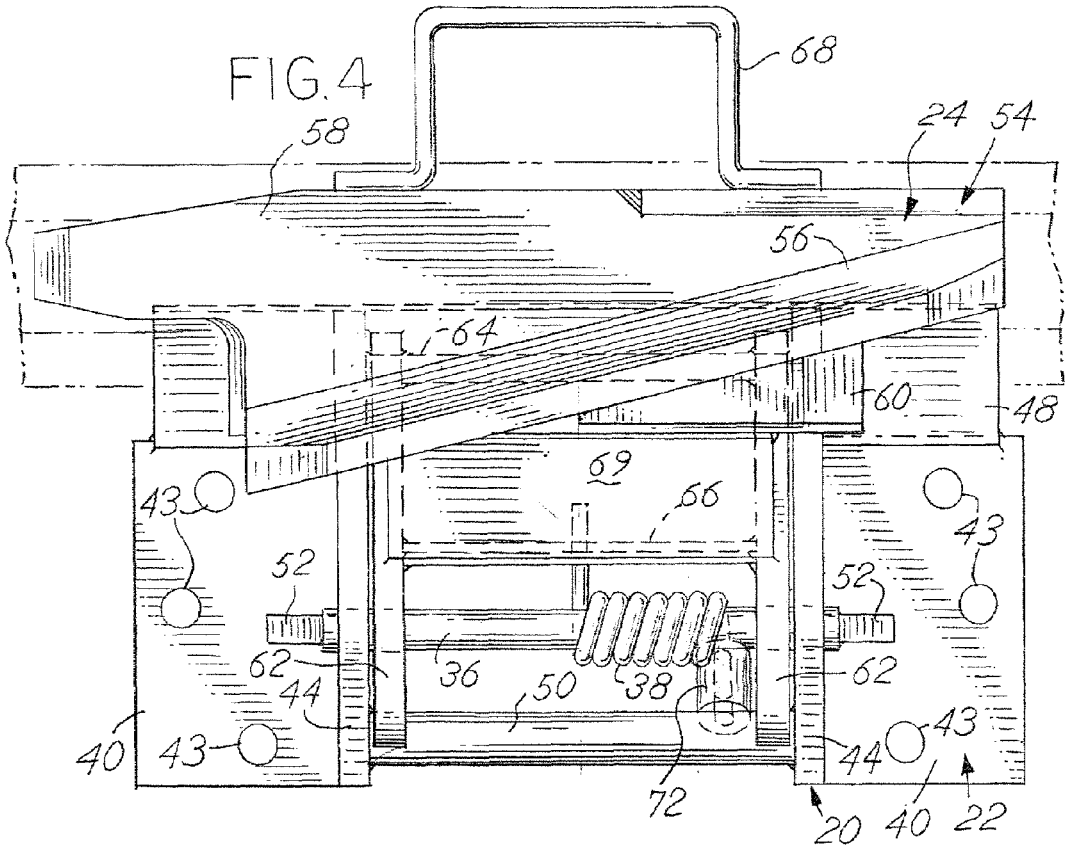
FIG. 4 is a top plan view of the derail embodiment of FIGS. 1-3, of the present invention with the derail shoe being in the operative position on top of the railroad rail.
Figure 5:
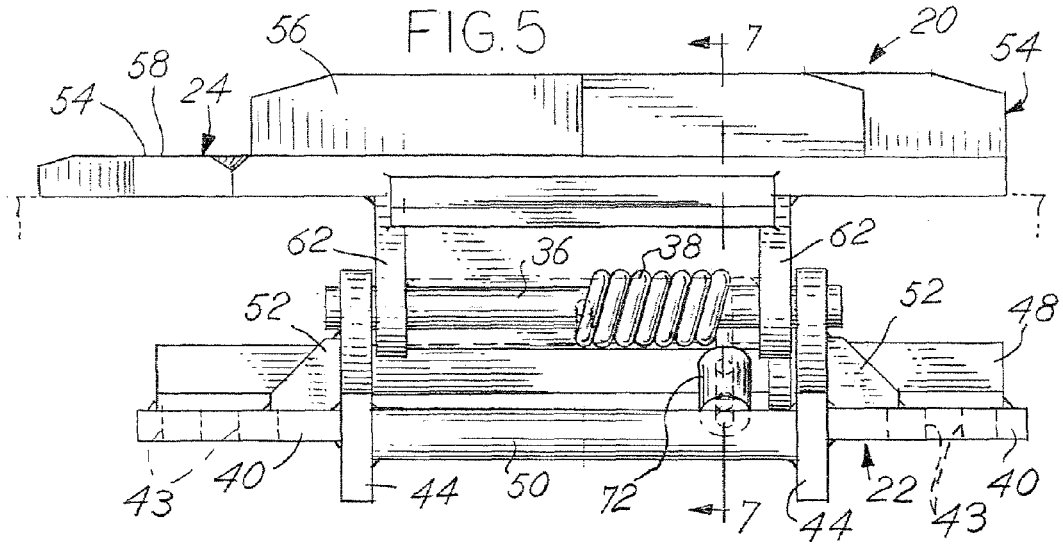
FIG. 5 is an end elevational view of the derail embodiment shown in FIGS. 1-4, as viewed from the pivot end of the derail.
Figure 6:
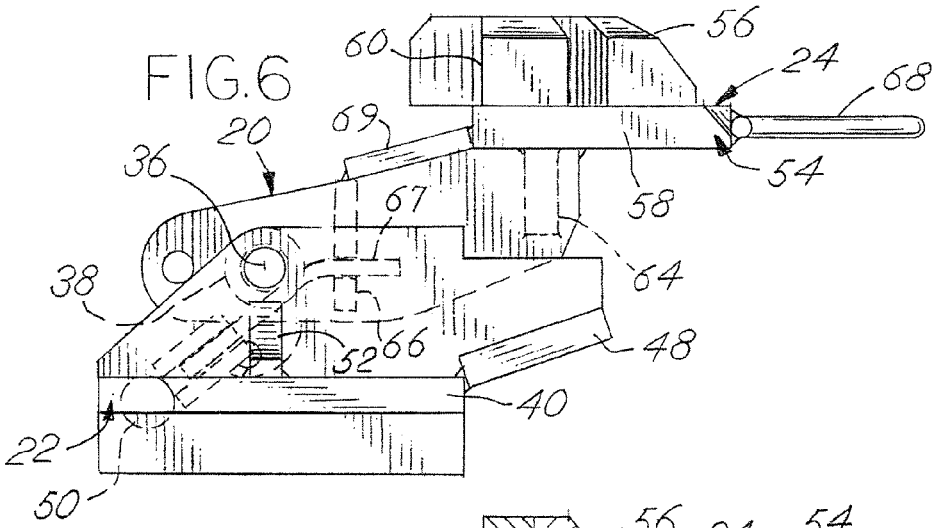
FIG. 6 is a side elevational view of the derail embodiment of FIGS. 1-5, with the derail shoe being in an operative position on top of a rail.
Figure 7:
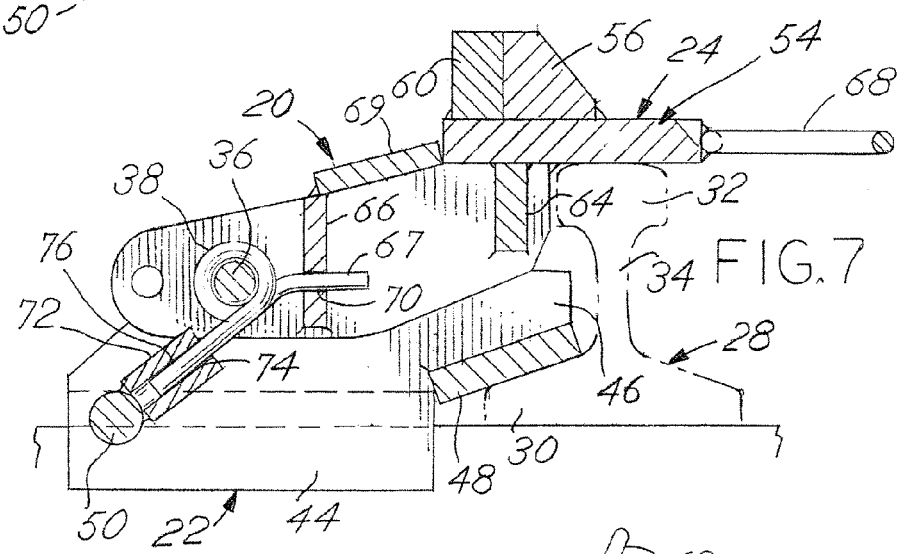
FIG. 7 is a sectional view of the derail embodiment of FIGS. 1-6, as viewed along line 7-7 of FIG. 5, showing the derail shoe mounted on a rail.

As seen in FIG. 4, the deflecting bar 56 is angled, broadly in a range of 11 degrees to 28 degrees from left to right, along and relative to the center line of the upper surface of the upper rail flange 32. When a rail car is undesirably moving along the rail 28, a wheel (not shown) of a railroad car (not shown) will be deflected off the rail 28. This derailing action thereby derails and stops the undesired movement of the car. It is to be understood that such deflecting bars may also be angled in the opposition direction, that is, in case of movement of a railcar in the opposite direction, as from right to left in FIG. 2. Furthermore, double ended derails, such as seen in U.S. Pat. No. 6,202,564, are designed to deflect a runaway rail car moving in either direction along a set of rails. Such a double ended derail embodying the present invention will be described in greater detail with reference to FIGS. 9-11. An added support block 60 is welded to the deflecting plate 54 and abutting against the deflecting bar 56 to provide added rigidifying support for maintaining the angled position of the deflecting bar 56 on the upper surface of the rail 28, as the wheel of an undesirably moving heavy rail car strikes the deflecting plate 54 and the angled deflecting bar 56.

A pair of spaced upright side plates 62 are rigidly mounted, as by welding on the under surface of the deflecting plate 54, as viewed when the deflecting plate 54 is in the position of FIG. 2. The laterally spaced side plates 62 are rigidly interconnected by a front cross brace 64 and a spaced rear cross brace 66, as viewed in FIG. 3. The front brace 64 and the rear brace 66 are each interconnected, by welding, to the inner faces of the spaced side plates 62. Another cross support brace 69 is welded to the top edges of the side plates, as viewed in FIG. 2. The side plates 62 and thereby the entire derail shoe 24, are pivotally carried on the pivot shaft 36 which is rigidly mounted on the base 22. The pivot shaft 36 is secured, as by welding, at its opposite ends to the flanges 44. The torsion spring 38 is mounted on the shaft 36 at the time of construction, as will be hereinafter described in greater detail.

The provision of the torsion spring 38 on the pivot shaft 36, as described herein, provides the desired assistance to manual lifting of the derail shoe 24. One problem with prior manually operated hinged derails is that the manual lifting of the heavy derail shoe 24 can cause injury, particularly back injuries, to the worker. Generally, prior derail shoes 24 of the type used in the railroad industry may weigh 80-120 pounds. The present derail 20 provides a convenient lift handle 68 for the operator to more easily grip the shoe 24. The handle 68 is fixed to the central outer portion of the deflecting plate 54 of the derail shoe 24. The operator must manually lift and pivot the derail shoe 24 upwardly between both the operative and inoperative positions of FIG. 2 and FIG. 3 respectively. The derail shoe 24 is the heaviest when it is completely on the rail, that is in the operative position, or off rail, that is, in the inoperative position. The weight of the shoe 24 is concentrated at its center of gravity which is horizontally farthest away from the pivot axis 36 when the shoe 24 is in the operative and inoperative positions.

During construction of the derail assembly 20, the torsion shaft 36 is passed through the spring 38. The shaft 36 thereby passes through the torsion spring 38 and also passes through the apertures provided in the upright support plates 62 and flanges 44. The outer ends of the shaft 36 are then securely mounted by welding in the openings provided in the upright flanges of the base 22. As seen best in FIGS. 6, 7 and 8, one substantially straight projecting end 67 of the torsion spring 38 is positioned in an aperture 70 on the rear cross brace 66 of the derail shoe 24. As seen in FIGS. 4, 5, 7 and 8, a cylindrical support member 72 is rigidly secured, as by welding, to the support rod 50 of the derail base 22. The support member 72 faces angularly upwardly and inwardly and includes a central aperture 74 which receives the opposite substantially straight projecting end 76 of the torsion spring 38. The spring 38 is thereby operatively secured at both ends 67 and 76 to the derail base 22 and to the pivoted derail base 24.

Figure 8:
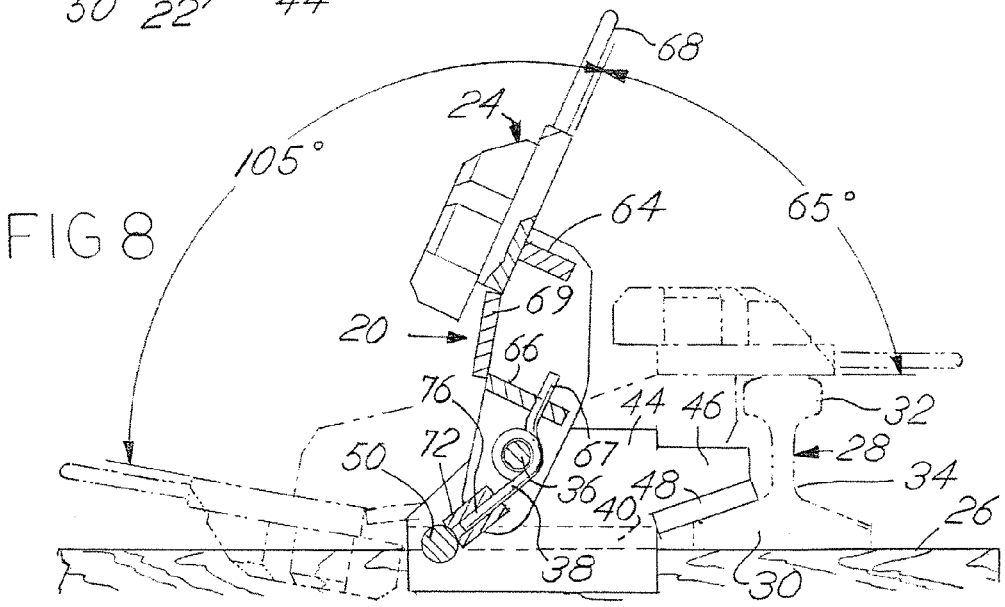
FIG. 8 is an illustrative drawing showing the derail shoe of FIGS. 1-7 in solid lines, when the torsion spring is in a substantially relaxed condition without biasing the derail shoe in either direction and also showing, in dotted lines, the positions of the derail shoe in both the inoperative position and in the operative position.

The torsion spring 38 is installed on the pivot shaft 36, when the pivoted derail shoe 24 is in the generally upright position, as shown in FIG. 8, when the center of gravity of the shoe is substantially directly above the pivot shaft 36. At this rotated position, the derail shoe 24 can be readily held in this generally upright position which is the approximate balance point of the shoe 24 pivotally carried on the base 22. The torsion spring 38 is passed around the pivot shaft 36. As previously described, the pivot shaft 36 is then passed through the openings in the upright flanges 44 of the derail shoe 24. The pivot shaft 36 is rigidly secured, as by welding, within the openings provided in the derail base 22. The shoe 24 is then pivotal relative to the base 22.

In further explanation, the torsion spring 38 is installed when in the solid line position of the upright derail shoe 24 shown in FIG. 8. The spring 38 is in an unstressed condition, because the center of gravity of the shoe is above the pivot axis of the shaft 36. When the shoe is pivoted to the inoperative position (FIG. 3) or to the operative position (FIG. 2), the spring 38 is in the wound or unwound position, that is, the spring is stressed. The torsion spring 38 tends to return to its unstressed condition when in either position. However, the weight of the derail shoe 24 is designed so as to not allow the spring 38 to move the shoe up to an unstressed condition. The stressed spring 38 thereby exerts a lift force against the derail shoe 24 in both positions but the torsion spring 38 and the weight of the shoe 24 are cooperatively designed to keep the shoe down in both the operative and inoperative positions.

Referring to FIGS. 1-8, a lighter weight derail, as about 95 pounds, is shown and the torsion spring 38 is in an unwound, stressed condition when the block or shoe 24 is on the rail 28 as seen in FIG. 2 and is in a wound, stressed condition when the spring 38 is in the off the rail position of FIG. 3. As most preferred, when the derail shoe 24 is on the rail 28 the weight of the shoe 24, such as about 95 pounds, overpowers the lift force of the stressed, unwound spring and the effort to lift the shoe 24 with the handle 68 is only approximately 15-20 pounds. Without the spring 38, the lift force would be at least 30-50 pounds. As the block 24 is further rotated to the off rail position, the spring 38 winds to the stressed, wound condition, increasing its potential energy. The weight of the block 24 overcomes the stressed spring. The lifting effort of the derail shoe 24 from off rail to on rail is also in the 15-20 pound range. In one embodiment, for example, when the weight of the shoe is lighter in weight and is approximately 95 pounds, the specifications of the spring 38 are as follows:

| Torsion | Cylind | Close Wound Chrome Vanadium | | Round | |
|---|---|---|---|---|---|
| Wire Dia (in) | 0.3310 | Mean Dia (in) | 1.5790 ± .032 | Active Coils | 11.2383 |
| Rate (#-in/deg) | 5.2195 | Inside Dia (in) | 1.2480 | Total Coils | 11.2383 |
| Spring Index C | 4.7704 | Outside Dia (in) | 1.9100 | Active Legs (in) | 0.0000 |
| Nat Preg (Hz) | 94.9118 | Min I.D. (in) | 1.2081 | Addl Feed (in) | 0.0000 |
| | | Body Length (in) | 4.0509 | Devel Lngth (in) | 55.7482 |
| | | Max Bdy Len (in) | 4.1474 | Weight (lbs) | 1.3624 |

| | Free | Point 1 | Point 2 |
|---|---|---|---|
| Moment Arms (in) | | | |
| Force at Arm (lbs) | | | |
| Moment (#-in) | 265.7702 | | |
| Angle (deg) | | | |
| Deflection (deg) | | | |
| UNK Stress (psi) | | | |
| UNK Stress % of MTS | | | |

The specifications for the spring 38, as would be apparent to one skilled in the art, vary depending on the weight of the derail shoe 24 as will be described hereinafter.

Manufacturing Method for the Embodiment of FIGS. 1-8

More specifically, the method of manufacturing the derail assembly 20 is as follows relative to the assembly of the torsion spring 38 on the assembly 20 as described. The derail shoe 24 is inserted into the base assembly 22. The pivot shaft 36 is passed through one side of the support flange 44 of the base 22 and then into the plate 62 of the derail shoe 24. At this time, the end 67 of the torsion spring 38 is inserted into the aperture 70 of the rear cross brace 66 of the shoe 24. The pivot shaft 36 is then passed in the same direction through the center of the torsion spring 38. The end 67 of the spring 38 is positioned in the brace 66 and then the pivot shaft 36 is passed through the opposite side plate of the shoe 24. The pivot shaft 36 is lined up with the aperture in the support flange 44 and the end of the pivot shaft 36 is inserted into the support flange 44. The pivot shaft 36 is then welded at both ends to the support flange 44 of the base 22. The aperture 74 of the cylindrical support member 72 is then slid over the straight projecting end 76 at the torsion spring 38. The derail shoe 22 is then pivoted upwardly approximately 65 degrees to a point where the derail shoe balances at its center of gravity relative to the pivot shaft 36. The spring 38 is unstressed when the derail shoe 24 is balanced. The final method of assembly is to then secure, as by welding, the cylindrical support member 72 to the support rod 50 at the base 22. The spring 38, being unstressed in the upright, balanced condition of the derail shoe 24, comes into a stressed condition, that is, in a wound or unwound condition, when the shoe 24 is in either the operational position or the inoperative position.

Referring again to FIG. 8, the dotted line views show the position of the derail block 24 in the operative position as well as in the inoperative position. As described and as shown in the drawings, there is approximately a 65 degree angle from the horizontal when a relatively light in weight derail shoe 24 is in the solid line position, that is, when the torsion spring is unstressed. Rotating the lighter derail shoe approximately 65 degrees to the on rail position unwinds the spring 38 and the spring 38 stores the strain energy for assisting in rotating the derail off the rail 28 when desired. In the opposite direction, which is from the 65 degree position of FIG. 8 to the hidden line, off rail position shown in FIG. 8, the lighter shoe 24 is approximately 105 degrees from the horizontal. Moving the shoe 24 to the inoperative position of FIG. 8 causes the spring 38 to store the strain energy and winds the spring. The strain energy thereby assists in rotating the lighter derail shoe to the on rail position of FIG. 2 from the off rail position of FIG. 3.

Figure 9:
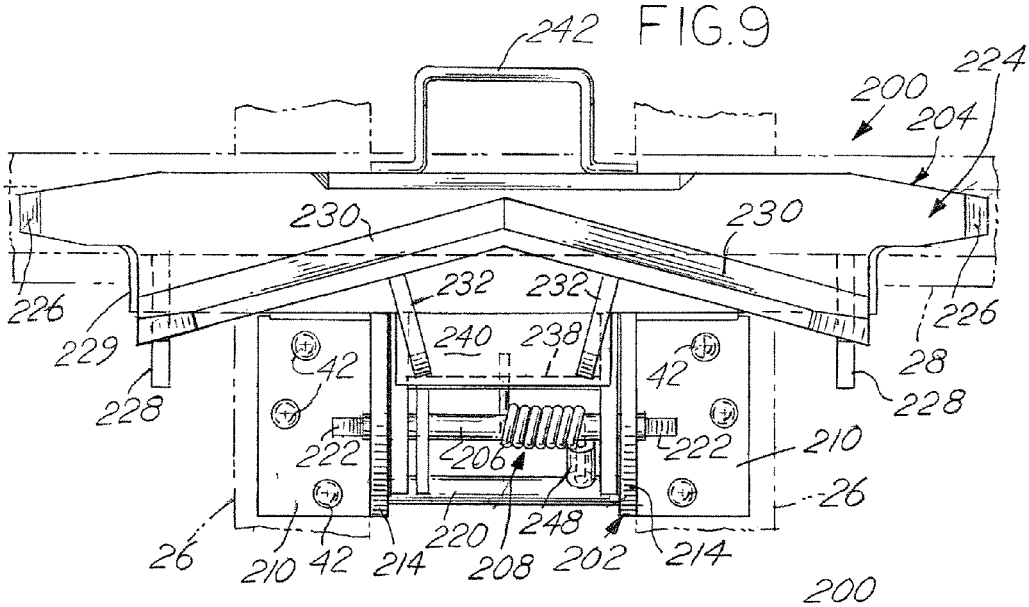
FIG. 9 is a top plan view of another embodiment of the derail of the present invention wherein the derail is a double ended derail and wherein the double ended derail is in the operative position on top of the railroad rail.
Figure 10:
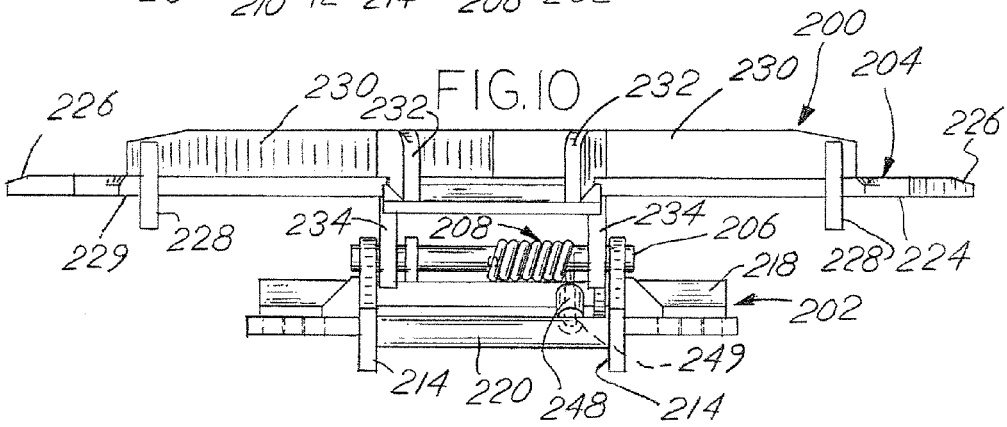
FIG. 10 is an end elevational view of the derail of FIG. 9 as viewed from the pivot end of the derail.
Figure 11:
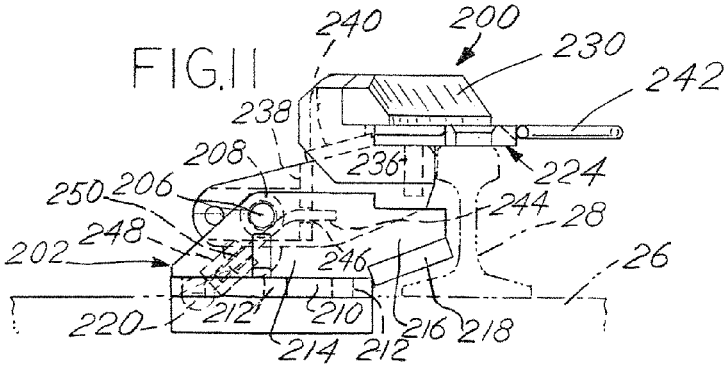
FIG. 11 is a side elevational view of the derail of FIGS. 9 and 10 with the derail shoe being shown in the operative position.

Double Ended Derail Embodiment of FIGS. 9-11

A second embodiment of the invention is shown in FIGS. 9-11. A double ended derail assembly, generally 200, is shown. The derail assembly 200 includes a derail base, generally 202 which pivotally carries a derail shoe, generally 204. The derail assembly 200 is shown in the operative position on a rail 28, shown in dotted line view in FIGS. 9 and 11. Also shown in dotted line view is a pair of railroad ties 26 mounted in a conventional manner transverse to the rail 28. The rail 28 rests upon the upper surface of the ties. The derail shoe 204 of the derail assembly 200 is pivotally mounted about a pivot shaft 206 which is spaced laterally inwardly from the rail 28 and is rigidly mounted on the derail base 202, to be described hereinafter in greater detail.

A torsion spring, generally 208, as seen in solid-line view in FIGS. 9 and 10 and in dotted-line view in FIG. 11 provides upward biasing or lifting assistance to the operator when the operator manually lifts the derail shoe 204 whether the derail shoe 204 is in the operative position of FIGS. 9-11 or in the inoperative position (not shown). As with the assembly of FIGS. 1-8, the torsion spring 208 is in a stressed condition, that is, in the wound or unwound conditions when the derail assembly 200 is in the operative position as shown in FIGS.

9-11 or in the inoperative position (not shown) such as shown, for example, in FIG. 3 of the single-ended derail embodiment of FIGS. 1-8.

The derail base 202 includes a pair spaced horizontal plates 210, each of which rests upon the upper surface of each of the spaced railroad ties 26. The horizontal plates 210 include multiple apertures 212 for allowing the passage of multiple railroad spikes 42 which are driven into the spaced railroad ties 26 in a conventional manner, for securing the assembly 200 in place on the ties 26 and adjacent a rail 28. The inner facing edges of the horizontal plates 210 have upright rigid support flanges 214 rigidly mounted thereon as by welding. The outer faces of the flanges 214 project downwardly and bear against the inner facing edges of the railroad ties 26 to provide added support for preventing rotational and transverse movement of the derail assembly 200 while being positioned on the ties 26 and adjacent to a rail 28. The upright flanges 214 each include unitary projections 216 having upwardly angled lower portions which project towards the rail 28. An angled cross support 218 is rigidly welded to the under portions of the projections 216 of the upright flanges 214. The angled cross support 218 generally extends along the entire width of the derail base in its position against the upper face of the lower flange of the rail 28. The angled cross support 218 is also welded to the inner facing edges of the horizontal plates 210 as seen best in FIG. 11.

A rigid support rod 220 is secured, as by welding, to the outermost portions of the spaced upright flanges 214. The support rod 220 is in general lateral alignment with the horizontal plates 210. A pair of support blocks 222 are welded to the upper surface of each horizontal plate 210 and to the outer face of each of the upright flanges 214. Each block 222 is positioned just below the pivot shaft 206. The derail base 202 is of heavy duty, rigid, construction and generally is comprised of the spaced horizontal plates 210, the angled cross support 218, the upright flanges 214 and the support rod 220. The derail base 202 is securely positioned against the rail 28 once the spikes 42 are driven through the apertures 212 in the horizontal plates 210.

Referring to FIGS. 9-11, the pivotally mounted derail shoe 204, like the base 202, is of welded steel construction. The derail shoe 204 includes a horizontal deflecting plate 224 which is designed to rest upon the upper surface of the upper flange of the rail 28 when in the operative or derailing position as seen in FIG. 11. As shown, the lower surface of the deflecting plate 224, which is in the operative position, bears against the upper rail flange of the rail 28. The opposite ends of the deflecting plate include downwardly and outwardly tapered surfaces 226 located above the rail and are designed to engage a wheel (not shown) of a wheeled vehicle (not shown) such as a freight car undesirably moving whether from the left side or the right side of the rail 28 as viewed in FIG. 9. A pair of transverse flanges 228 are welded to the outer portions 229 of the deflecting plate 224 and project generally rearwardly from the deflecting plate 224 when resting on the rail 28.

A pair of oppositely angled deflecting bars 230 are mounted on the upper surface of the deflecting plate 224 when in the operative position. The deflecting bars 230 abut each other at the center of the deflecting plate 224 and are welded to the upper surface of the deflecting plate 224, as seen in FIG. 9. Each bar 230 extends laterally and angularly outwardly toward the opposite sides of the shoe 204. The outer portions of the deflecting bars 230 are also rigidly supported at their outer positions by the transverse flanges 228 which are secured to the deflecting plate 224. The deflecting bars 230 and the deflecting plate 224 are constructed and arranged to derail a wheel (not shown) of an undesirably moving rail car whether moving from the left side or the right side as viewed in FIG. 9, thereby defining the double-ended derailing capabilities of the double-ended derail assembly 200. Preferably, as seen in U.S. Pat. No. 6,202,564, the deflecting bars each have a deflecting surface which preferably is angled relative to the longitudinal axis of the rail 28 of not more than about 15°. The disclosure concerning double ended derails of U.S. Pat. No. 6,202,564 is incorporated herein by reference.

A pair of rigid, upright support plates 232 are welded to the rear side of each of the rearwardly and outwardly angled deflecting bars 230 to thereby provide added rigid support for maintaining the angled position of the deflecting bars 230 on the upper surface of the rail 28 as the wheel (not shown) of an undesirable moving heavy rail car (not shown) strikes either deflecting plate 224 and ultimately either of the deflecting bars 230, whether the car movement is left to right or right to left as viewed in FIG. 9.

A pair of spaced upright side plates 234 are rigidly mounted, as by welding, on the under surface of the deflecting plate 224 as viewed in FIGS. 9-11. The laterally spaced side plates 234 are rigidly interconnected by a front cross brace 236 and by a rearwardly spaced cross brace 238. Another cross support brace 240 is secured as by welding to the top edges of the side plates 234. The side plates 234, and thereby the entire rigidly constructed derail shoe 204 are pivotally carried on the pivot shaft 206 for pivotal or hinged movement about the derail base 202. The pivot shaft 206 is secured as by welding at its opposite ends to the transverse flanges 214. The torsion spring 208 is mounted around the shaft 206 at the time of manufacture.

The provision of the torsion spring 208 on the pivot shaft 206 provides the desired assistance to the manual lifting of the derail shoe 204. A double-ended derail such as the double-ended derail 200 of the present invention is quite heavy due to the use of additional steel and is close in weight to 120 lbs. The derail 200 further includes a lift handle 242 for the operator so as to more easily grasp and lift the shoe 204. The handle 242 is secured at the central outer portion of the deflecting plate 224 of the derail shoe 204. The torsion spring 208 provides lifting force for manual lifting both when in operative and inoperative positions. The derail shoe 204 is the heaviest when it is completely on the rail 28 or off the rail 28. The off rail position of the derail assembly 200 is not shown but for purposes of simplicity and as will be apparent to one skilled in the art, the off rail position will be substantially the same as the off rail position of the derail assembly 20, as shown in FIGS. 1-8 hereof.

During construction of the derail assembly 200, the pivot shaft 206 is passed through the torsion spring 208. The shaft 206 is also passed through apertures provided in the side plates 234 of the shoe 204 and the opposite ends of the shaft 206 are received in and secured, as by welding, in apertures provided in the flanges 214 of the base 202. One substantially straight projecting end 244 of the torsion spring 208 is received in an aperture 246 provided in the rear cross brace 238. A cylindrical support member 248 is rigidly secured, as by welding, to the support rod 220 of the derail base 202. The support member 248 projects angularly upwardly and inwardly towards the rail 28 and includes a central aperture 249. The opposite substantially straight projecting end 250 of the spring 208 is received in the aperture 249. The torsion spring 208 is thereby operatively secured at both ends to the derail base 202 and to the derail show 204.

The specifications for the spring 208, as would be apparent to one skilled in the art, vary depending on the weight of the derail shoe 204. In the double ended derail embodiment 200 of FIGS. 9-11, for example, when the weight of the shoe is heavier in weight and may weigh about 110-120 pounds, the specifications of the spring 208 are as follow:

| Torsion | Cylind | Close Wound Chrome Vanadium | | Round | |
|---|---|---|---|---|---|
| Wire Dia (in) | 0.4060 | Mean Dia (in) | 1.7300 + .032 | Active Coils | 13.2300 |
| Rate (#-in/deg) | 9.1600 | Inside Dia (in) | 1.3240 | Total Coils | 13.2300 |
| Spring Index C | 4.2611 | Outside Dia (in) | 2.1360 | Active Legs (in) | 0.0000 |
| Nat Preg (Hz) | 82.3814 | Min I.D. (in) | 1.2867 | Addl Feed (in) | 0.0000 |
| | | Body Length (in) | 5.7774 | Devel Lngth (in) | 71.9045 |
| | | Max Bdy Len (in) | 5.8958 | Weight (lbs) | 2.6437 |

| | Free | Point 1 | Point 2 |
|---|---|---|---|
| Moment Arms (in) | | | |
| Force at Arm (lbs) | | | |
| Moment (#-in) | | | |
| Angle (deg) | 262.8000 | | |
| Deflection (deg) | | | |
| UNK Stress (psi) | | | |
| UNK Stress % of MTS | | | |

Manufacturing Method for the Embodiment of FIGS. 9-11

It is to be understood that the method of manufacturing the double ended derail embodiment 200 of FIGS. 9-11 is substantially the same as for the method of manufacture for the derail assembly 20 of FIGS. 1-8. Therefore, it is considered unnecessary to substantially repeat the method of manufacture of the derail assembly 200 in order for one skilled in the art to fully understand the method of manufacture.

While in the foregoing there has been provided a detailed description of two embodiments of the present invention, it should be recognized to those skilled in the art that the described embodiments may be altered or amended without departing from the spirit and scope of the invention as defined in the accompanying claims.

What is claimed is:

1. A hinged derail assembly for derailing a wheel of a wheeled railed vehicle, the derail assembly being mounted on railroad ties and beings electively positioned adjacent one rail for accomplishing said derailing of desired movement of the wheeled vehicle, said derail assembly comprising:

a base rigidly secured to said rail ties;

a derail shoe pivotally mounted on said base for manual movement between an operative, derailing position and an inoperative position, said derail shoe having a derail member positioned on said rail when in the operative position on said rail for deflecting said wheel from rolling on said rail and for thereby derailing said wheeled vehicle; and a biasing member operatively secured to both said base and said derail shoe for biasing said derail shoe in a substantially upward rotational direction for forcibly assisting in the manual lifting movement of said derail shoe both from the inoperative position to the operative derailing position and from the operative derailing position to the inoperative position, said derail shoe, when in a substantially upright position, being in a substantially unstressed condition from said biasing member.

2. The derail assembly of claim 1 wherein said biasing member is a spring member having a first end and a second end, means on said base for receiving said first end of said spring member, and means on said derail shoe for receiving said second end of said biasing member.

3. The hinged derail assembly of claim 2 wherein said spring member is a torsion spring, a rigid pivot shaft being mounted on said base, said spring member being mounted on said pivot shaft and said derail shoe being pivotally mounted on said pivot shaft for pivotal movement between the operative and inoperative positions.

4. The derail assembly of claim 3 wherein said torsion spring is selectively in a wound condition or an unwound condition when said derail assembly is in said operative position or in said inoperative position.

5. The derail assembly of claim 1 wherein said derail member is constructed to deflect said wheel only when said wheeled vehicle is rolling on said rail in one direction.

6. The derail assembly of claim 1 wherein said derail assembly is a double ended derail having a pair of derail members constructed to deflect said wheel of said wheeled vehicle when said wheeled vehicle is moving in either of two directions.

7. The derail assembly of claim 6 wherein said derail members are angled in opposite directions when in said operative derailing position.

8. The derail assembly of claim 7 wherein said derail members are angled at about 15° or less relative to said one rail when in said operative derailing position.

9. A method for constructing a derail assembly for derailing a wheel of a wheeled railed vehicle, said derail assembly being of the type which includes a derail base, a derail shoe pivotally mounted on said about a pivot shaft for manual movement between an operative position for derailing said wheel and an inoperative position, said method comprising the steps of:

providing a biasing member having first and second ends for biasing said derail shoe in a substantially upward rotational direction for forcibly assisting in the manual lifting movement of said derail shoe both from said inoperative position to the said operative position and from the said operative position to the said inoperative position;

providing a rigid member for receiving said second end of said biasing member;

positioning said biasing member on said pivot shaft;

receiving said first end of said biasing member on said derail shoe;

pivoting said derail shoe to a substantially upright and balanced condition relative to said pivot shaft and above said derail base while maintaining said biasing member in an unstressed condition;

securely positioning said second end of said biasing member on said rigid member while continuing to maintain said biasing member in an unstressed condition; and rigidly securing said rigid member to said derail base while continuing to maintain said biasing member in an unstressed condition while in said substantially upright and balanced condition.

10. The method of claim 9 including the further step of positioning said derail shoe in the operative position and simultaneously causing said biasing member to be in a stressed condition to assist in the manual movement of said derail shoe from the operative position to the inoperative position.

11. The method of claim 9 including the further step of positioning said derail shoe in the inoperative position and simultaneously causing said biasing member to be in a stressed condition to assist in the manual movement of said derail shoe from the inoperative position to the operative position.

12. The method of claim 9 including the step of providing a torsion spring as the biasing member and positioning said torsion spring around said pivot shaft.

* * * * *